US006478397B2

(12) United States Patent
Chang et al.

(10) Patent No.: US 6,478,397 B2
(45) Date of Patent: Nov. 12, 2002

(54) METHOD OF ARRANGING ORIFICES ON A PRINT HEAD AND THE CORRESPONDING STRUCTURE

(75) Inventors: Charles C. Chang, Hsinchu (TW); Hui-Huang Chang, Hsinchu (TW); Yu-Chu Huang, Taipei (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 09/910,877

(22) Filed: Jul. 24, 2001

(65) Prior Publication Data

US 2002/0118240 A1 Aug. 29, 2002

(30) Foreign Application Priority Data

Feb. 23, 2001 (TW) ..... 90104127 A

(51) Int. Cl.[7] ..... B41J 29/38
(52) U.S. Cl. ..... 347/12; 347/41
(58) Field of Search ..... 347/12, 15, 40, 347/41, 43, 16

(56) References Cited

U.S. PATENT DOCUMENTS 6,193,347 B1 * 2/2001 Askeland et al. ..... 347/15
6,264,298 B1 * 7/2001 Mantell ..... 347/15

OTHER PUBLICATIONS

Article: "Photographic Quality Imaging with HP Thermal InkJet" by Dr. Ross R. Allen, Project Manager Date: unknown.

* cited by examiner

*Primary Examiner*—Lamson Nguyen
(74) *Attorney, Agent, or Firm*—Birch, Stewart, Kolasch & Birch, LLP

(57) ABSTRACT

A method of arranging orifices on a print head and the corresponding structure. The invention uses a design that changes relative positions of orifices on a print head so that different ink droplets for the same pixel fall in different areas of the pixel. The printing quality is enhanced because of a more homogeneous distribution of the ink droplets.

10 Claims, 10 Drawing Sheets

METHOD OF ARRANGING ORIFICES ON A PRINT HEAD AND THE CORRESPONDING STRUCTURE

BACKGROUND OF THE INVENTION

1. Field of Invention

The invention relates to a method of arranging orifices on a print head for inkjet printers and the corresponding structure.

2. Related Art

Conventional inkjet printers use color mixing or half-tone processing of ink droplets to print colors at desired pixel positions on a medium (such as paper or transparencies), producing varied color levels thereon. However, the sizes of conventional ink droplets are slightly bigger, roughly 80–100 pl. (pico-liter). Taking the printing resolution of 300 dpi (dot per inch) as an example, a single droplet occupies a whole pixel. Therefore, there are very limited possible color variations.

To enhance the printing quality, producing more continuous, varied colors, the key issue is to make each pixel contain as many colors as possible. A trivial solution is to make the ink droplets smaller. For example, the photo resolution enhancement technology (PhotoRET) proposed by Hewlett Packard is one of the solutions to enhance the photo image quality. On the other hand, color print heads (with CMY colors) are also improved so that each droplet jetted out is only 30 pl. big. Therefore, any pixel position can be controlled to have more droplets (0–3 droplets). As the number of droplets in each pixel changes, the area occupied also varies to present different colors. The ink droplet jetted out of the state-of-art print heads can be even smaller, about 10 pl. That is, each pixel can have 0–8 ink droplets. As shown in FIGS. 1A, 1B, 1C, and 1D ("Photographic Quality Imaging With HP Thermal Inkjet", Edited by Dr. Ross R Allen, Printing Technology Department HP Laboratories, Palo Alto, Calif. USA.), if the print head 10 prints none, 1 droplet, three droplets or 8 droplets of ink 20, respectively, the medium 30 will have four color levels ranging from white to dark. With color mixing effect, more than 250 colors can be produced on the medium, greatly enriching the color contents and increasing the number of color levels.

This type of multilayer dot printing can provide photograph quality printing. The increase in color levels does not need half-tone processing when the image color changes, rendering smoother gradient fill. Furthermore various printing color combinations allow the fine-tuning function of printers for color processing and corrections.

When applying the above-mentioned multilayer dot printing in light color areas, the number of ink droplets 20 needed is less (please refer to the area being colored with ink droplets 20 in FIGS. 1B and 1C are that in FIG. 3 with 0–7 ink droplets) and the ink droplets are sprayed at the same position on the medium 30. Therefore, the printed area becomes bigger and bigger but it never fills the whole pixel, resulting in gaps that are not covered by colors among pixels, as shown in FIG. 2 ("Photographic Quality Imaging With HP Thermal Inkjet", Edited by Dr. Ross R Allen, Printing Technology Department HP Laboratories, Palo Alto, Calif. USA.). Taking a sheet of white paper as an example, white spots 40 are formed after printing, seriously deteriorating the image quality. Moreover, as one can see from FIG. 4, when the number of ink droplets is 4, the open lines 50 produced in the horizontal and vertical directions can be easily discovered with even naked eyes. So the multilayer dot technology still has many defects for many specific image contents, far from reaching the photo image quality.

SUMMARY OF THE INVENTION

An object of the invention is to provide a method of arranging orifices on a print head and the corresponding structure so that the sizes of open lines can be minimized in printing.

According to the disclosed method and structure, the invention properly arranges relative positions of orifices on a print head so that diff rent ink droplets for the same pixel fall at different positions in the pixel. The distribution of the ink droplets in the pixel can be more homogeneous so that no obvious open lines can be seen.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 5:
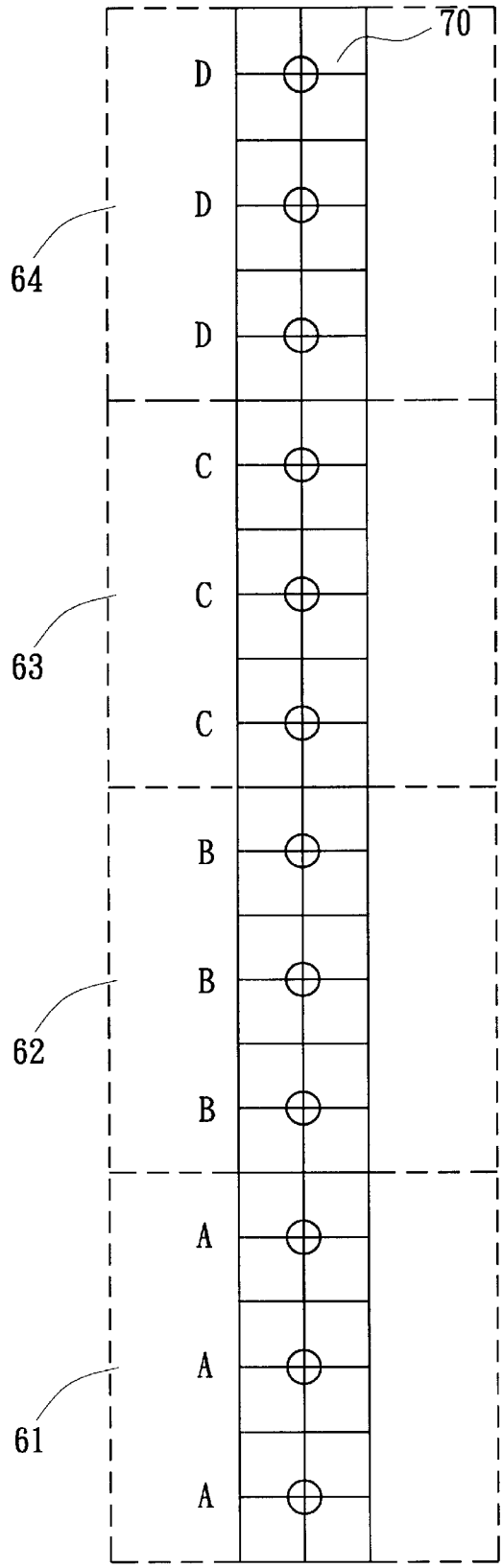
Fig. 5 (PRIOR ART)
FIG. 5 shows the orifice positions on a conventional print head.
Figure 6:
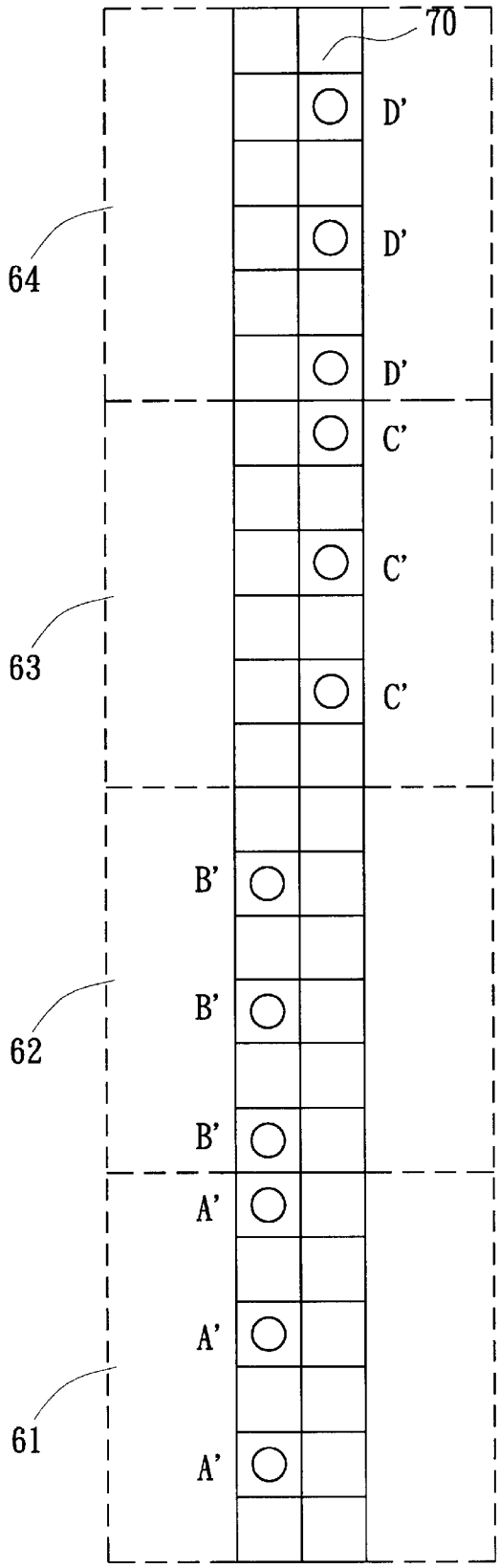
FIG. 6 shows the orifice positions on a print head of the invention.

A normal print head is configured with two or more rows of orifices. The vertical spans between orifices in the same row are the same, while the horizontal spans can be displaced to avoid crosstalks. When the print head 10 moves, the orifices in the same row can simultaneously spray ink, but the ink supply may not be able to fast enough, thus lowering the quality if the printing speed is the same. For the convenience of demonstration, we ignore the horizontal spans & cross talk and suppose there are four orifice sets, each having three orifices. Referring to FIG. 5, the first orifice set 61 has three orifices A, the second orifice set 62 has three orifices B, the third orifice set 63 has three orifices C. and the fourth orifice set 64 has three orifices D. The orifices A, B, C and D are along a straight line and any two orifices in each set are separated by a distance equal to the length L of the side of a pixel. To make the droplet distribution in the pixel 70 more homogeneous, the positions of the orifices A, B, C, and D are changed to A', B', C', and D' (FIG. 6). That is, the orifices A' have the same positions as the orifices A. The orifices B are shifted downwards by L/2 (half the pixel side length) to the orifices B'. The orifices C are shifted to the right by L/2 to the orifices D'. These orifice sets can use the center of a pixel as the center of a polar coordinate system and divide the pixel into four (corresponding to the number of orifice sets) equal areas from zero degree. Of course, each orifice in each orifice set is located in the same orientation corresponding to different pixel centers. The correspondence relation among each orifice set is not necessarily the same as the one used in the current embodiment.

Figure 7A:
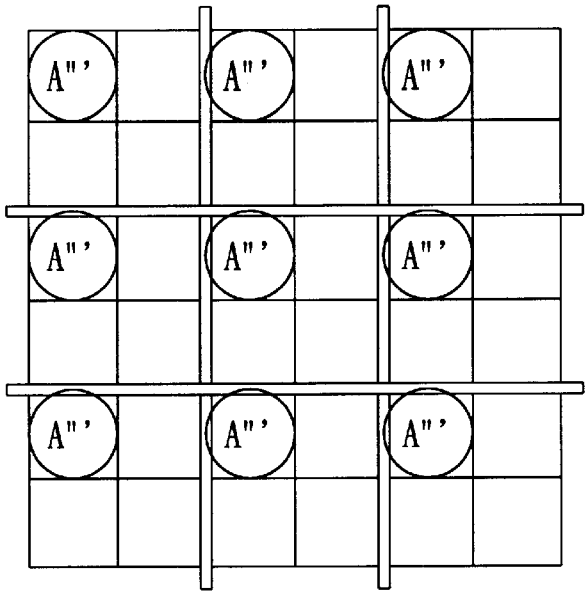
FIGS. 7A through 7D schematically show the sequence of printing on a medium using the orifices of the invention and the produced open lines.
Figure 7B:
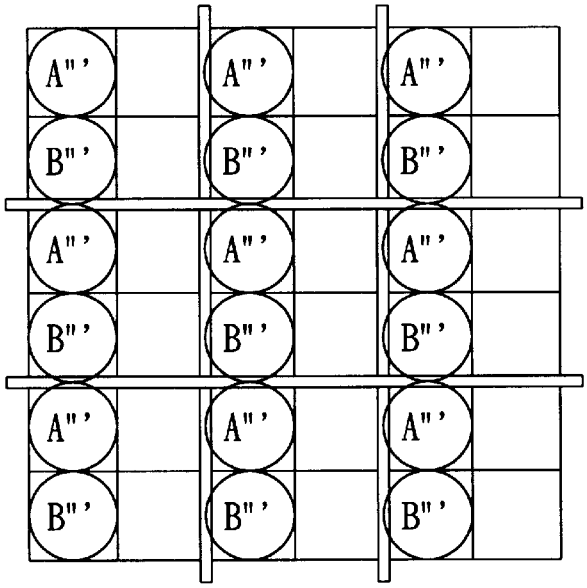
Figure 7C:
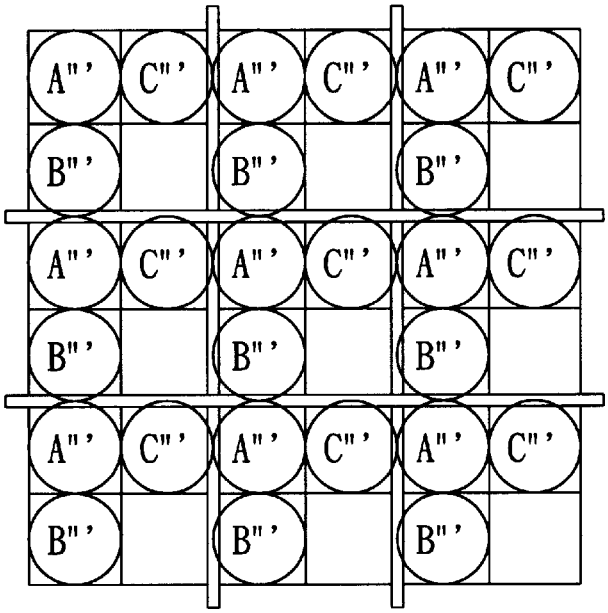
Figure 7D:
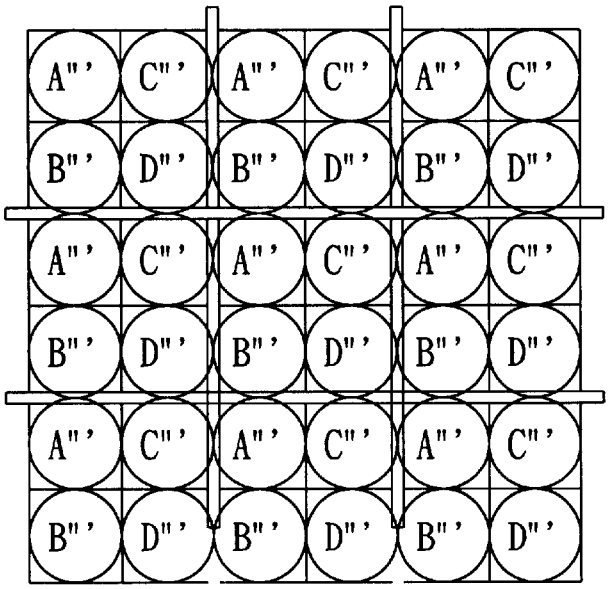

When printing, the orifices A', B', C', and D'first spray ink on the medium once, then move downwards by 3L (three pixel lengths) and spray ink again. After four such moves and ink jets, the print head 10 can evenly distribute ink droplets in the four areas in the pixel 70. As shown in FIG. 7D, wherein A, B, C, and D corresponds to the shifted orifices A', B', C', and D' in FIG. 5, the orifices A' spray ink once on the medium. Then the print head 10 moves from left to right twice, so as to obtain the ink A''' printed in a pixel shown in FIG. 7A. Afterwards, the print head moves downwards by 3L and then moves from left to right twice, so as to obtain the ink B''' printed in a pixel 70 as in FIG. 7B. Again, the print head moves downwards by 3L and then moves from left to right twice, so as to obtain the ink C''' printed in a pixel 70 as in FIG. 7C. Finally, the print head moves downwards by 3L and then moves from left to right twice, so as to obtain the ink D''' printed in a pixel 70 as in FIG. 7D.

Therefore, the ink droplets A''', B''', C''', and D'''are evenly distributed in a pixel 70 on the medium, thus enhancing the image quality.

Figure 1A:
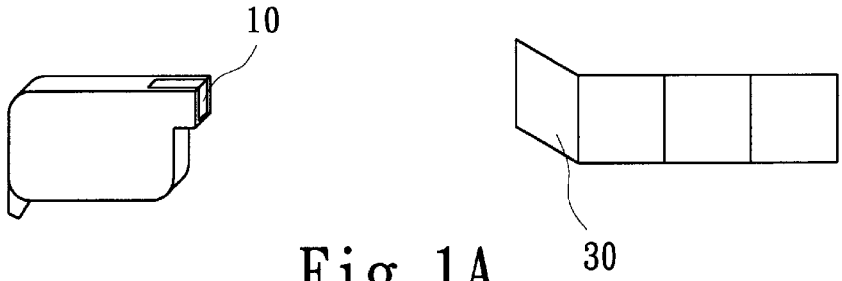
Fig. 1A (PRIOR ART)
FIGS. 1A–D schematically show the number of ink droplets and the printing range in a pixel in conventional inkjet printing.
Figure 1B:
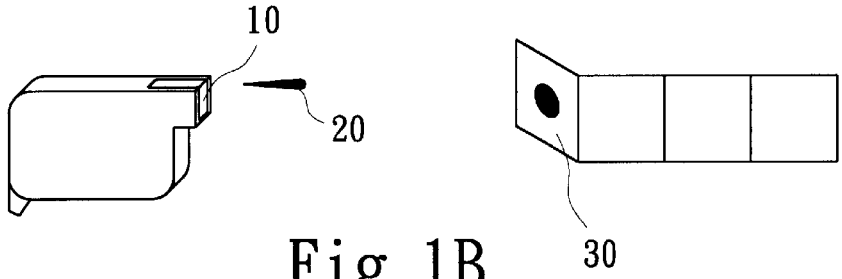
Fig. 1B (PRIOR ART)
Figure 1C:
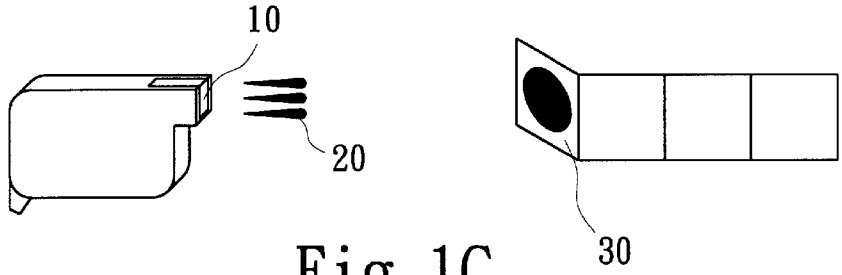
Fig. 1C (PRIOR ART)
Figure 1D:
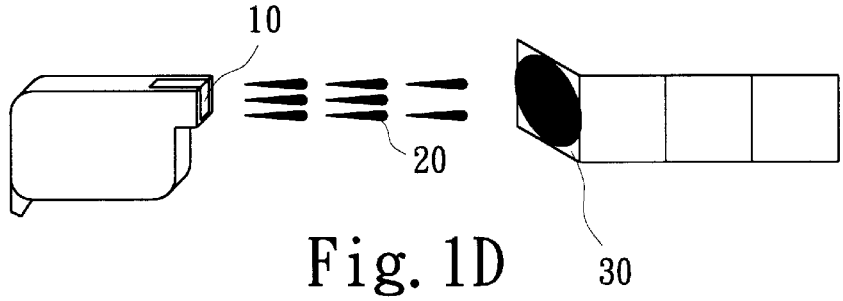
Fig. 1D (PRIOR ART)
Figure 2:
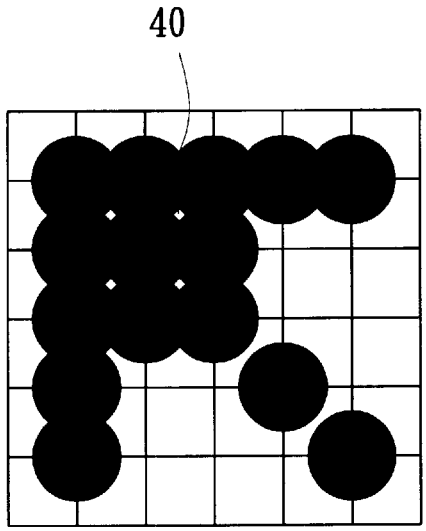
Fig. 2 (PRIOR ART)
FIG. 2 is a schematic view showing white spots in an image printed in the prior art.
Figure 3:
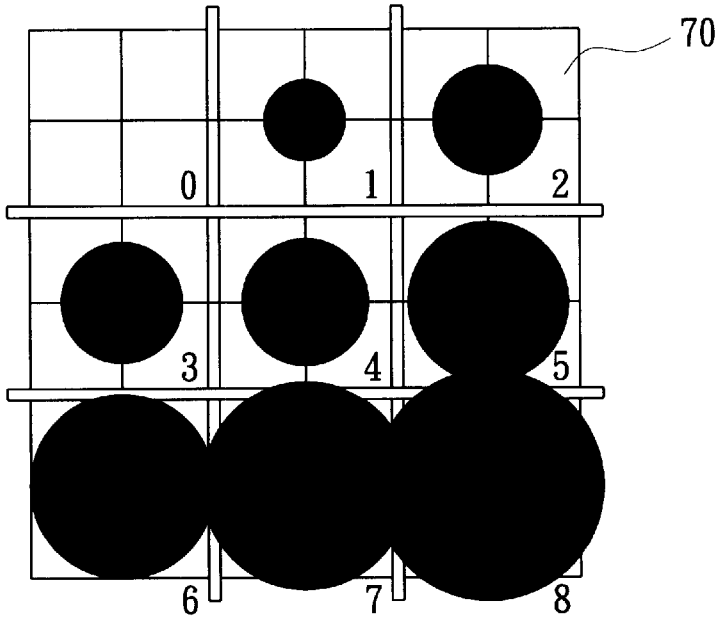
Fig. 3 (PRIOR ART)
FIG. 3 is a schematic view showing the printing ranges in a pixel for different numbers of ink droplets in conventional inkjet printing.
Figure 4:
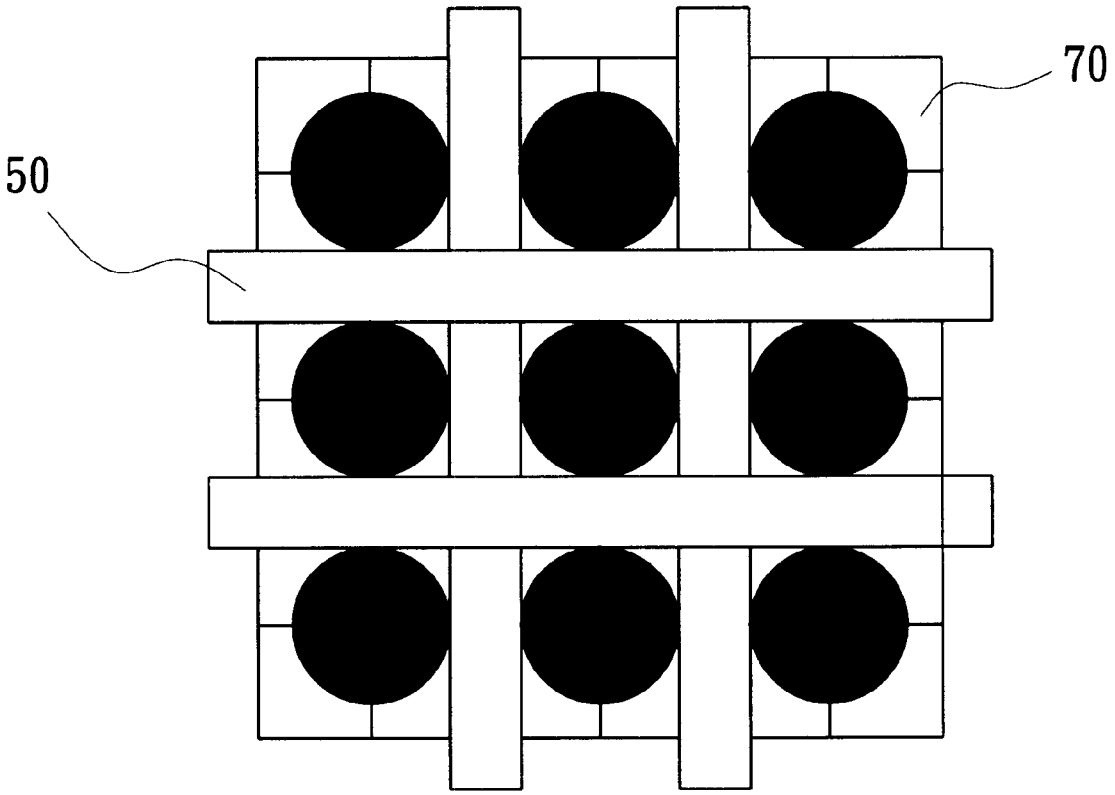
Fig. 4 (PRIOR ART)
FIG. 4 is a schematic view showing open lines in an image printed in the prior art.

Similarly, from FIG. 7D one can clearly see that the open lines generated in the printed image is far thinner than those in FIG. 4 and hardly recognizable. Thus, the invention is able to enhance the printing quality. Furthermore, the invention does not need to change the scan speed of the print head or the printing order. It can even achieve the objects without the need to change the feed-in paper amount of the printer each time.

Figure 8:
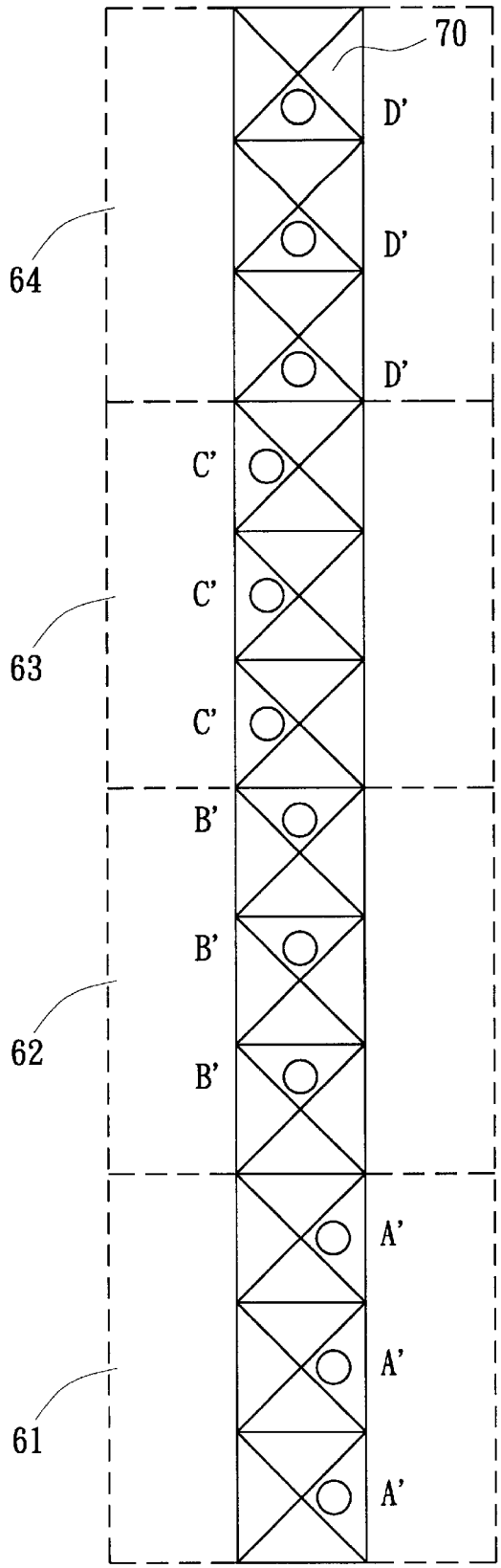
FIG. 8 shows the orifice positions of another embodiment of the invention.

The arrangement of the orifices A', B', C', and D'can use the pixel center as its polar coordinate system origin. The pixel is then divided into four (corresponding to the number of the orifice sets) equal areas starting from the 45-degree direction. Of course, each orifice in each of the orifice sets is located in the same orientation corresponding to the different pixel centers. As shown in FIG. 8, the orifices A' in the first orifice set 61 is located in the 0-degree direction of the pixel center. The orifices B' in the second orifice set 62 is located in the 90-degree direction of the pixel center. The orifices C' in the third orifice set 63 is located in the 180-degree direction of the pixel center. The orifices D' in the fourth orifice set 64 is located in the 270-degree direction of the pixel center. Moreover, the correspondence relation among each set of orifices is not necessarily the same as the illustrated embodiment. They only need to fall within the area of each pixel.

Figure 9:
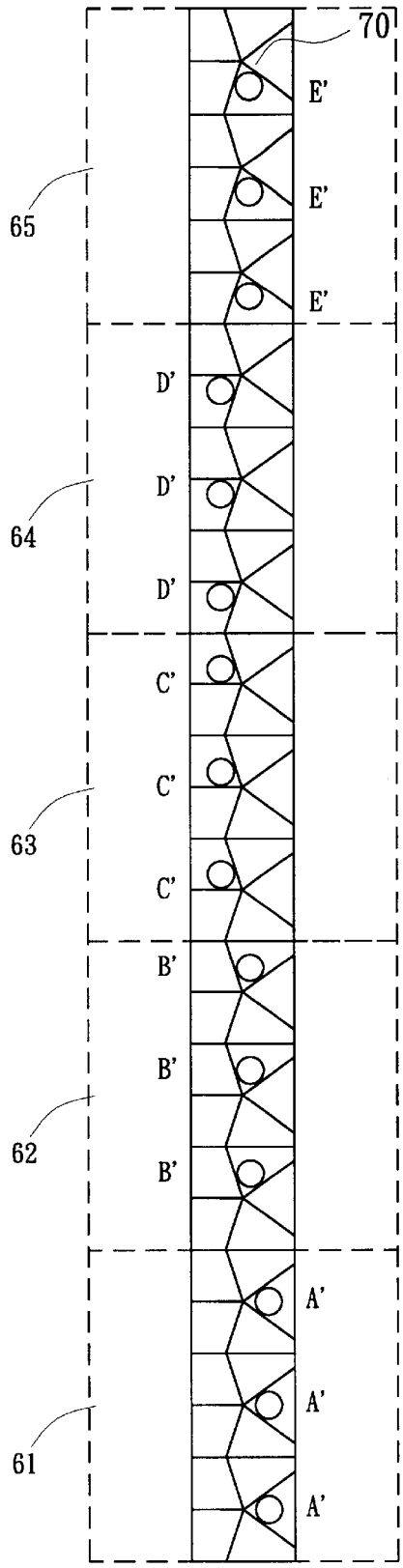
FIG. 9 shows the orifice positions of yet another embodiment of the invention.

Analogously, the pixel center can be taken as the polar coordinate system origin. Starting from the 0-degree direction, the pixel is divided into five equal areas. Of course, each orifice in each of the orifice sets is located in the same orientation corresponding to the different pixel centers. As shown in FIG. 9, the number of the orifice sets is five (61, 62, 63, 64. 65). Each set corresponds to one of the five areas. The orifices A' in the first orifice set 61 is located in the 0-degree direction of the pixel center. The orifices B' in the second orifice set 62 is located in the 72-degree direction of the pixel center. The orifices C' in the third orifice set 63 is located in the 144-degree direction of the pixel center. The orifices D' in the fourth orifice set 64 is located in the 216-degree direction of the pixel center. The orifices E' in the fifth orifice set 65 is located in the 288-degree direction of the pixel center. Again, the correspondence relation among each set of orifices is not necessarily the same as the illustrated embodiment. They only need to fall within the area of each pixel.

Based upon the previous description, the span between the orifices A, B, C, D and the orifices A', B', C', D'does not need to be the same as the pixel side length L. The way that the orifices A', B', C', D'is displaced is not necessarily in a way that three orifices form a set. Therefore, the distribution of ink droplets and ink locations in the same pixel is not necessarily the same as before. The arrangement of the orifices A', B', C', and D' can be different from the previously disclosed order. That is, the orifices do not need to be assigned clockwise or counterclockwise. The number of the orifice sets can be varied. Even the orifices do not need to have equal distances to the pixel center.

Figure 10:
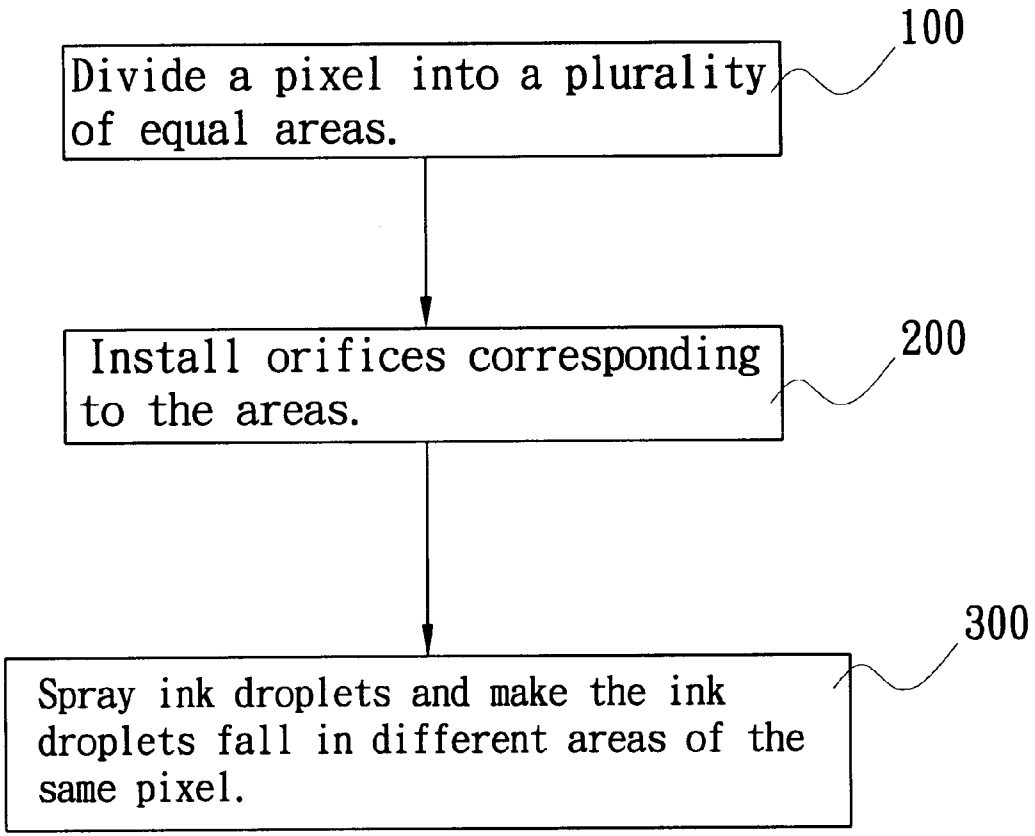
FIG. 10 shows a flowchart of the invention.

As shown in FIG. 10, the method of arranging orifices in a print head contains the following steps: First, each pixel is divided into several equal areas, using each pixel center as the polar coordinate system origin (step 100). Several sets of orifices in the same orientation are then installed on the print head (step 200). The several sets of orifices then spray ink droplets in the corresponding areas according to needs so that ink droplets fall in different areas in the same pixel (step 300).

Of course, the number of areas in step 100 can be four. Each area can use the pixel center as the polar coordinate system origin and the division can start from the 0-degree or 45-degree direction.

EFFECTS OF THE INVENTION

According to the disclosed method and structure, the invention has the following advantages:

1. It reduces the sizes of open lines produced in printed images (particularly for light color areas), providing a better image quality.
2. One only needs to change the positions of the orifices on a print head without changing other control mechanisms (such as the print head scan speed, the printing sequence, or the paper feed-in distance in the printer), thus lowering the complexity.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An ink overprinting method of multiple drop per pixel by a print head, which comprises the steps of:

a) dividing each pixel into M areas;

b) installing N orifice sets on the print head, each orifice set includes M orifices corresponding to said M areas of each pixel;

c) selecting a printing orifice from said M orifices in sequence;

d) making said selected printing orifices of said N orifice sets spray ink droplets into the corresponding area of each pixel; and e). finishing if all of said M orifices have been selected, otherwise back to step c).

2. The method of claim 1, wherein step a) divides each of the pixels into a plurality of equal areas.

3. The method of claim 2, wherein each of the pixels is divided into four equal areas.

4. The method of claim 3, wherein each of the pixels is divided by a vertical line and a horizontal line through the center of said pixel.

5. The method of claim 3, wherein each of the pixels is divided by two diagonal lines of said pixel through the center of said pixel.

6. A print head for overprinting multiple drop per pixel, comprising N orifice sets installed on the print head, wherein each orifice set includes M orifices corresponding to M areas of each pixel, said M orifices of said N orifice sets spray ink droplets into the corresponding area each pixel in sequence to overprint per pixel M times.

7. The print head of claim 6, wherein each of the pixels is divided into a plurality of equal areas.

8. The print head of claim 7, wherein each of the pixels is divided into four equal areas.

9. The print head of claim 8, wherein each of the pixels is divided by a vertical line and a horizontal line through the center of said pixel.

10. The print head of claim 8, wherein each of the pixels. is divided by two diagonal lines of said pixel through the center of said pixel.

* * * * *